US007504027B2

(12) United States Patent
Cosentino

(10) Patent No.: US 7,504,027 B2
(45) Date of Patent: Mar. 17, 2009

(54) REMOTE CONTROL POOL SKIMMER

(75) Inventor: Ronald R. Cosentino, Seneca Falls, NY (US)

(73) Assignee: Dunn-Rite Pool Products, Inc., Elwood, IN (US)

( * ) Notice: Subject to any disclaimer, the term of this patent is extended or adjusted under 35 U.S.C. 154(b) by 240 days.

(21) Appl. No.: 11/538,956

(22) Filed: Oct. 5, 2006

(65) Prior Publication Data

US 2007/0095731 A1 May 3, 2007

Related U.S. Application Data

(60) Provisional application No. 60/731,575, filed on Oct. 28, 2005.

(51) Int. Cl.
*E04H 4/16* (2006.01)

(52) U.S. Cl. ..... 210/167.2; 210/242.1

(58) Field of Classification Search ..... 210/210, 210/167.1, 167.19, 167.2, 242.1; 4/496
See application file for complete search history.

(56) References Cited

U.S. PATENT DOCUMENTS

| | | | | |
|---|---|---|---|---|
| 3,268,081 | A | 8/1966 | Menkee et al. | 210/242 |
| 3,928,206 | A | 12/1975 | Warren | 210/242 |
| 4,305,830 | A * | 12/1981 | Shimura | 210/801 |
| 4,813,366 | A * | 3/1989 | Elder | 114/290 |
| 4,820,411 | A | 4/1989 | Lempio | 210/169 |
| 4,900,432 | A | 2/1990 | Arnold et al. | 210/91 |
| 4,906,366 | A | 3/1990 | Moore | 210/242.3 |
| 5,106,492 | A | 4/1992 | Distinti et al. | 210/91 |
| 5,911,878 | A | 6/1999 | Benvenuto et al. | 210/169 |
| 6,132,604 | A | 10/2000 | Kirchoff | 210/169 |
| 6,471,862 | B1 | 10/2002 | Rockwell | 210/242.3 |
| 7,101,475 | B1 * | 9/2006 | Maaske et al. | 210/106 |
| 2006/0060513 | A1 * | 3/2006 | Craig | 210/169 |

FOREIGN PATENT DOCUMENTS

| | | | |
|---|---|---|---|
| FR | 2796576 | * | 1/2001 |
| JP | 8-230773 | * | 9/1996 |

* cited by examiner

*Primary Examiner*—Fred Prince
(74) *Attorney, Agent, or Firm*—Woodard, Emhardt, Moriarty, McNett & Henry LLP

(57) ABSTRACT

A remote control pool skimmer for picking up surface debris, according to one embodiment of the present invention, comprises a pair of elongated buoyant hulls spaced from one another, each hull having a bow and a stern, and at least one cross member interconnecting the hulls to one another, a remotely controlled drive system connected to the pool skimmer for propelling the hulls across the surface of the water in a selected direction and a collection net spanning the space between the pair of hulls, the net being oriented in order to collect surface debris as the hulls move through the water. In terms of weight distribution from bow to stern, the hulls are weighted more toward the stern.

11 Claims, 7 Drawing Sheets

REMOTE CONTROL POOL SKIMMER

CROSS REFERENCE TO RELATED APPLICATIONS

The present application claims the benefit of U.S. Provisional Patent Application Ser. No. 60/731,575 , filed Oct.28, 2005, entitled "REMOTE CONTROL POOL SKIMMER" which is hereby incorporated by reference in its entirety.

BACKGROUND OF THE INVENTION

The present invention relates in general to swimming pool skimmers that are constructed and arranged to collect surface debris from a swimming pool or similar body of water. More specifically, the present invention relates to a remote controlled swimming pool skimmer.

Swimming pool skimmers have been in use for a number of years as one way to remove surface debris from a body of water. When swimming pools are exposed to nearby deciduous trees and similar vegetation that has a tendency to discharge leaves, seedlings, and other debris, these items can fall into the swimming pool or can be swept into the swimming pool by wind. If not removed promptly, these items of debris typically sink to the bottom of the pool. Debris on the bottom of the pool is more difficult to remove and if not removed, may interfere with the swimming pool filtering system. In the simplest form, such surface debris can be removed from the pool by a net at the end of a long pole. However, this particular approach requires some degree of strength and coordination and constitutes an unpopular chore. While swimming pool services can perform this task for the owners, that comes at an added cost.

There have been proposals in the past for automatic pool skimmers having some type of buoyant vessel supporting a porous basket. These structures are specifically designed for collecting leaves and other surface debris as the skimmer is propelled through the water, skimming across the surface of the water. However, many of these earlier devices have the disadvantage of having to free themselves when they go into the side of the pool. In addition, some of these prior devices present cumbersome and awkward structural arrangements for removing debris and/or the porous basket.

While the present invention is described in the context of a swimming pool, the problems and issues described above also exist, at least to some degree, for small man-made lakes and other similar bodies of water where the debris falls along the shoreline. Accordingly, the present invention is directed to providing certain improvements and benefits for such automatic pool skimmers in the form of a device that is remotely controlled, providing another advantage and convenience to the user.

BRIEF SUMMARY OF THE INVENTION

A remote control pool skimmer for picking up surface debris, according to one embodiment of the present invention, comprises a pair of elongated buoyant hulls spaced from one another, each hull having a bow and a stern, and at least one cross member interconnecting the hulls to one another, a remotely controlled drive system cooperating with the pool skimmer for moving the hulls through the water in a given direction and a collection net spanning the space between the pair of hulls, the net being oriented in order to collect surface debris as the hulls move through the water. In terms of weight distribution from bow to stern, the hulls are weighted nonlinearly more toward the stern.

One object of the present invention is to provide an improved remote control pool skimmer.

Related objects and advantages of the present invention will be apparent from the following description.

DETAILED DESCRIPTION OF THE INVENTION

Figure 1:
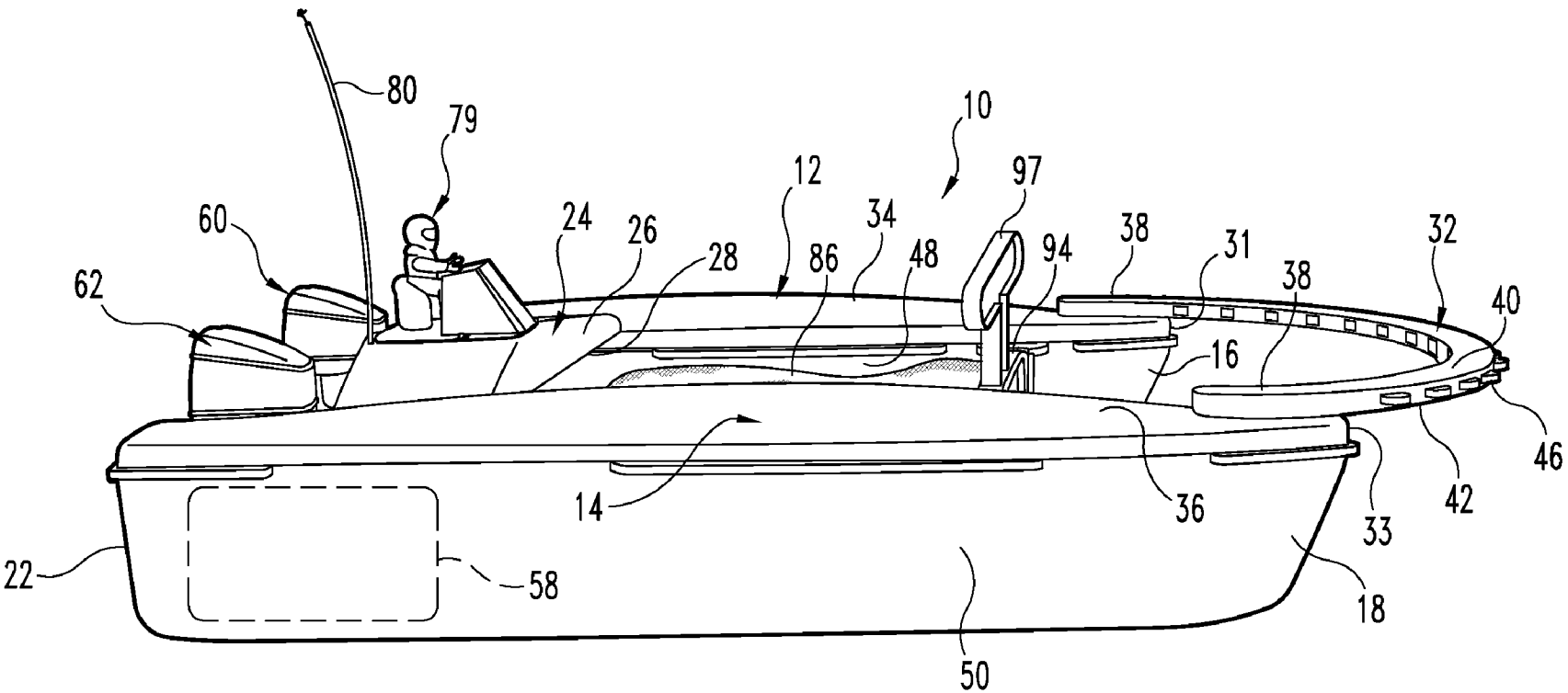
FIG. 1 is a starboard side elevational view of a pool skimmer.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
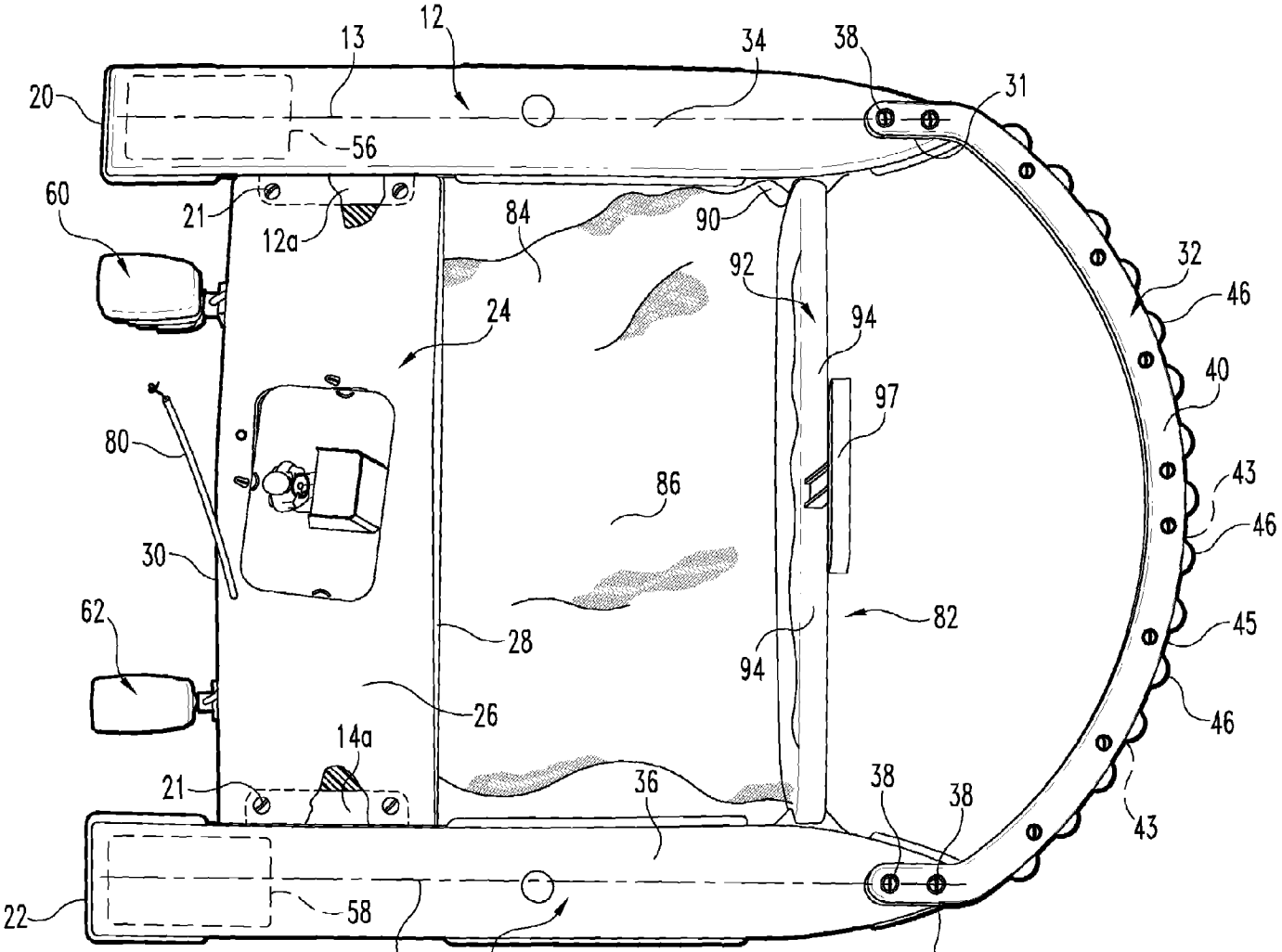
FIG. 2 is a top plan view of the pool skimmer in FIG. 1 showing a debris collecting net in place.
Figure 3:
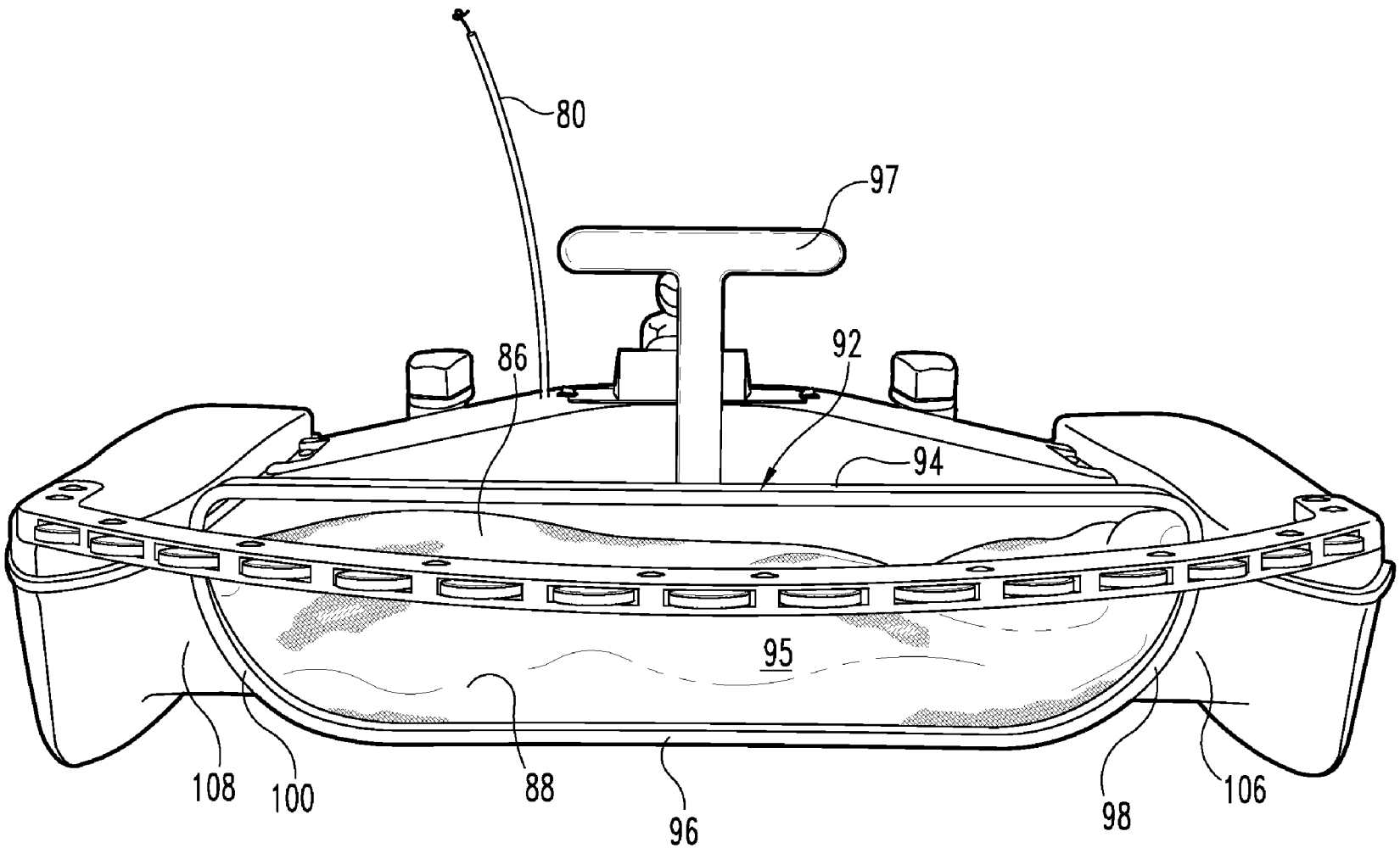
FIG. 3 is a front elevational view of the pool skimmer of FIG. 1.
Figure 4:
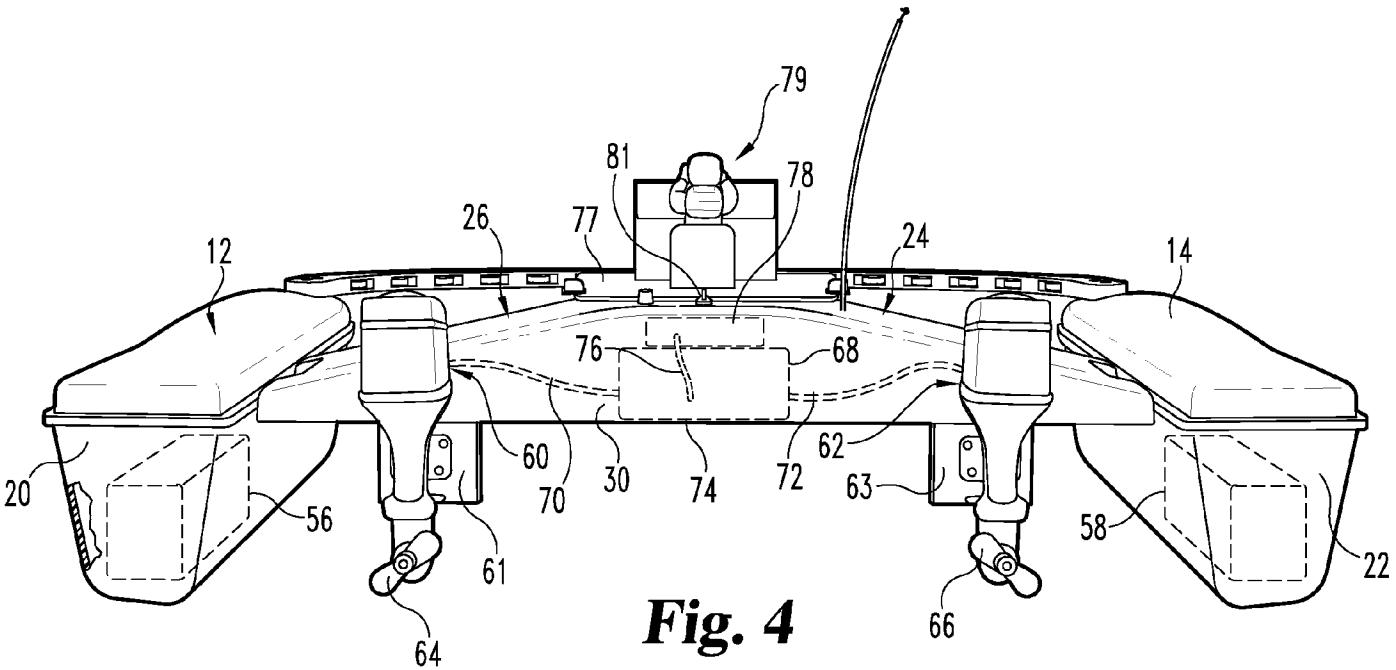
FIG. 4 is a rear elevational view of the pool skimmer of FIG. 1

Referring to FIGS. 1-7, there is illustrated a swimming pool skimmer 10 that is constructed and arranged according to the present invention. Skimmer 10 comprises a pair of spaced pontoons 12 and 14 that are arranged so as to be generally parallel to one another and having tapered bows 16 and 18 respectively. Pontoons 12 and 14 also have sterns 20 and 22, respectively, as shown in FIG. 4. A cross member 24 extends between pontoons 12 and 14 at a substantially right angle with respect to the longitudinal axis (line 13) of each pontoon 12 and 14. Cross member 24 provides structural interconnection between the pontoons 12 and 14 by way of flanges 12*a* and 14*a* and threaded fasteners 21. The hollow construction of cross member 24 and pontoons 12 and 14 provides a housing for other components, such as, for example, control and propulsion components. Cross member 24 includes an upper surface 26 and fore and aft side walls 28 and 30, respectively. Sidewalls 28 and 30 are constructed and arranged to reinforce the upper surface 26. This construction provides the described hollow interior for receipt and/or placement of control and propulsion components.

The bow ends 31 and 33 of the pontoons 12 and 14, respectively, are structurally interconnected by a curved frame member 32 secured to an upper housing 34 of pontoon 12 and an upper housing 36 of pontoon 14 by means of screws 38. Frame member 32 comprises upper and lower walls 40 and 42, respectively, having a series of recesses 43 between them to accommodate a plurality of rollers 46. A series of shafts (not shown) extend between walls 40 and 42 and provide a means for journaling the rollers 46 that are uniformly spaced around the circumference of frame member 32. The rollers 46 are journaled so that at least a portion of their periphery extends forward beyond the outer circumference 45 of frame member 32.

Figure 4A:
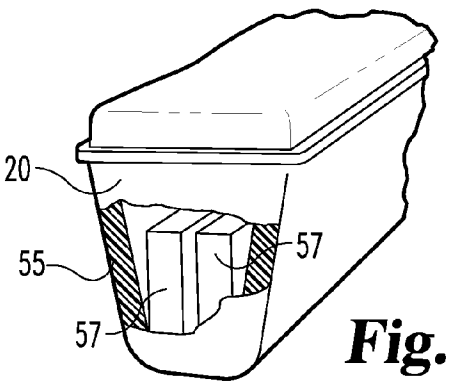
FIG. 4A is a partial, fragmentary, perspective view of one pontoon with alternative weighting.
Figure 5:
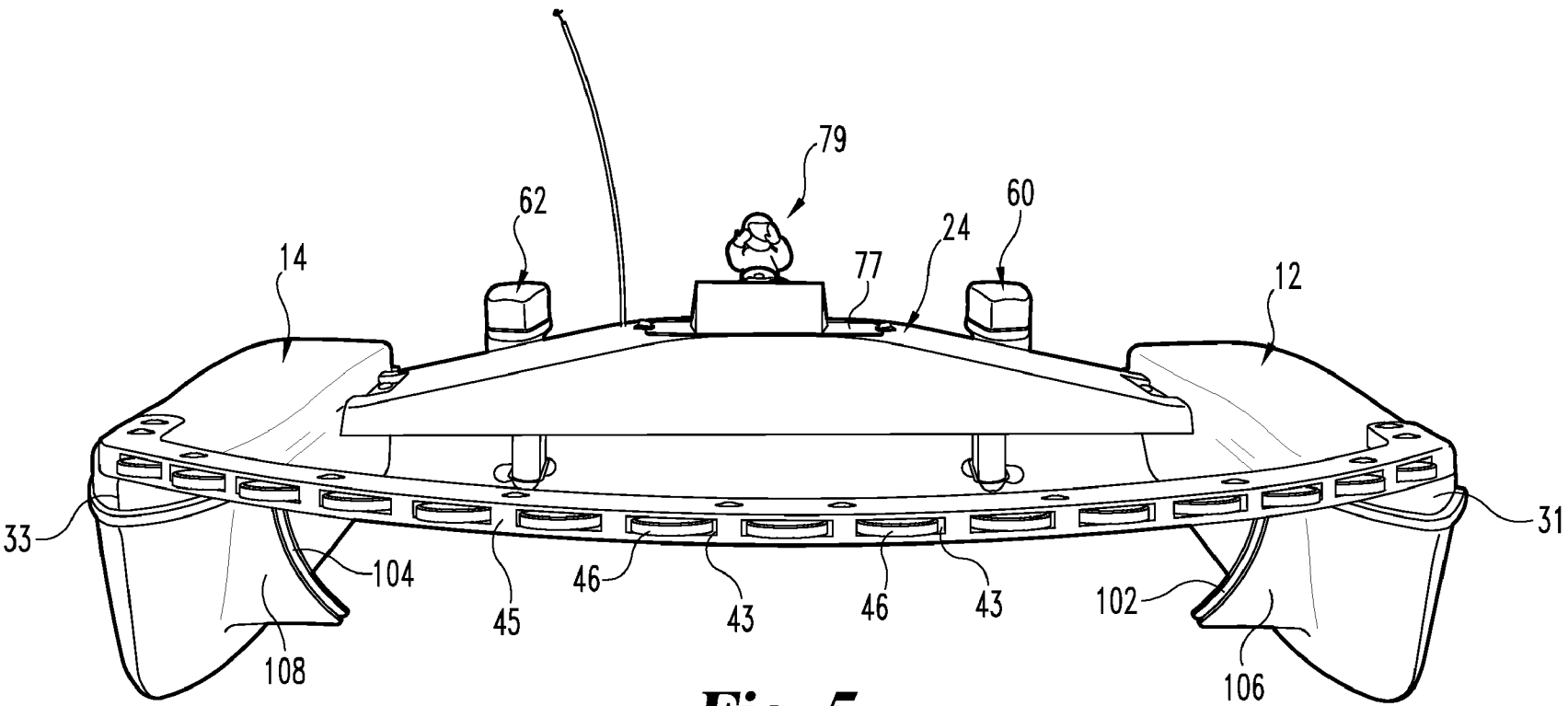
FIG. 5 is a front elevational view of the pool skimmer of FIG. 1 with the debris collecting net removed.
Figure 6:
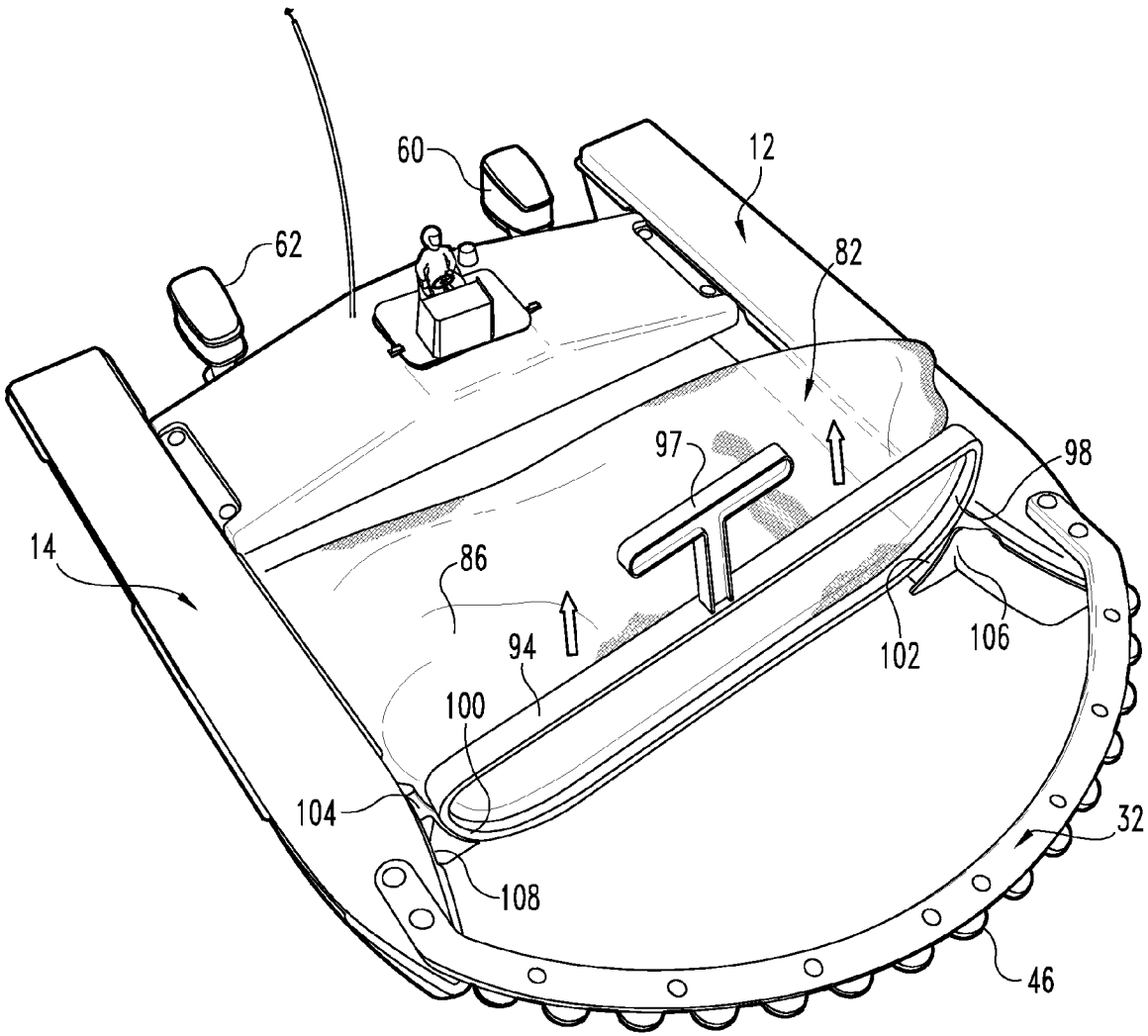
FIG. 6 is a perspective view of the skimmer of FIG. 1, showing the debris collecting net in the process of being removed from the pool skimmer.
Figure 7:
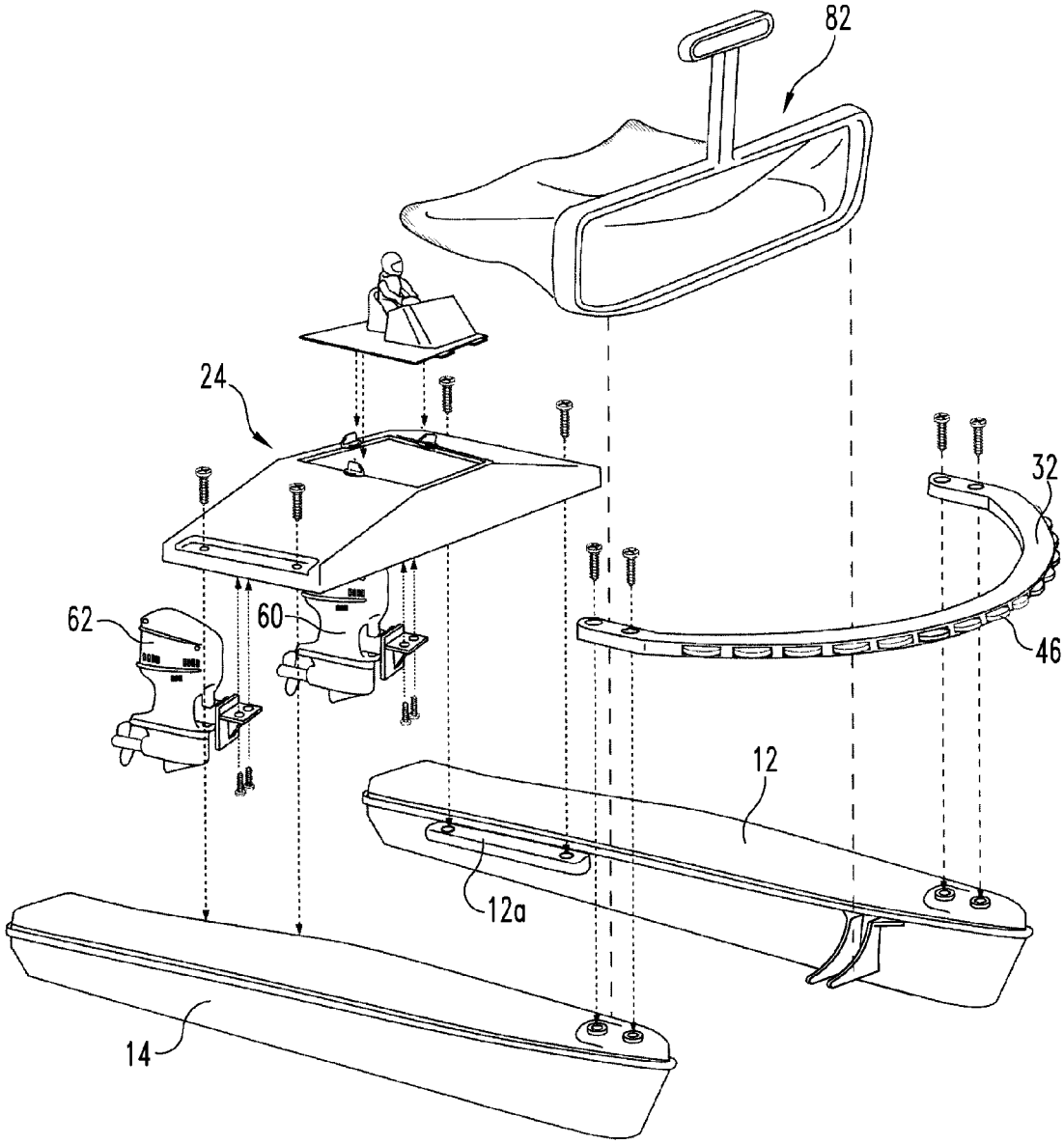
FIG. 7 is an exploded view of the FIG. 1 pool skimmer.

Pontoons 12 and 14 may be formed from any appropriate material such as fiberglass, plastics, metal, and the like so long as the pontoons provide buoyancy for the device 10. The pontoons 12 and 14 each have lower hulls 48 and 50 which mate with upper housings 34 and 36, respectively. The lower hulls 48, 50 and upper housings 34, 36 are fastened together, respectively, by either glue, heat welding or other means to form watertight, buoyant compartments. In one embodiment of the present invention, as shown by dashed lines 56 and 58, weights are incorporated in the aft end of the pontoons for a purpose to be described later. In another embodiment of the present invention, see FIG. 4A, this "weighting" is achieved by using thicker wall sections 55 and/or by creating added walls or ribs 57 to weight the stern greater than the bow. This weighting is non-linear with a greater proportion of the weight being provided to the stern half of the two pontoons 12 and 14.

The back wall 30 of cross support 24 has mounting plates 61, 63 forming supports for a pair of propulsion units 60 and 62, respectively secured thereto by suitable fasteners. Propulsion devices 60 and 62 are electrically operated motors with an internal electrical motor driving propellers 64 and 66 through an appropriate power train. It should be apparent to those skilled in the art that the propulsion units 60 and 62 can be provided in a number of forms so long as they have the ability to propel the device 10 through the water at a thrust which can be varied both in absolute magnitude and relative to one another. The electric motors and the propulsion devices 60 and 62 are driven by a controller 68 (shown by a dashed outline) positioned and mounted in the hollow interior of structural cross member 24. As shown herein, propulsion devices 60 and 62 simulate full-size outboard motors with a small fractional horsepower electric motor used as the prime mover. It should be apparent to those skilled in the art that the number of motors can be varied and the exact means of propulsion can be varied from open propellers as shown herein, to ducted propellers, to jet drive. Furthermore, although the propulsion devices 60 and 62 are shown as fixed in position and the relative speed of the propulsion devices is varied to guide the boat and control its speed, a single motor may be employed with the ability to swivel and thus achieve the directional capabilities.

The motors 60 and 62 may also be used in conjunction with a rudder or rudders (not shown) which may be fixed or adapted to pivot so as to guide the boat. Propulsion devices 60 and 62 receive electrical power through lines 70 and 72 (shown herein by dashed lines). These lines extend to the power output section 74 of the controller 68, also indicated by dashed lines. As shown herein, the controller is from a radio controlled model boat that is used to control the relative current to the motors 60 and 62 to control the speed and the direction of the skimmer 10. Controller 68 receives power from line 76 connected to a battery pack 78, both shown by dashed lines. As shown herein, the voltage for the battery pack 78 is 9.6 volts and the battery pack 78 is rechargeable. It should be apparent to those skilled in the art, however, that other voltages and other forms of batteries may be employed in the illustrated device. An antenna 80 facilitates reception of signals from a remote control transmitter, not shown in order to provide a more concise description of the present invention. A removable cover 77 provides access for battery pack 78 and a pedestal for a scale size boat pilot 79. An on-off toggle switch 81 is included.

The control system and propulsion units are available from a number of outlets including Radio Shack®. It is apparent to those skilled in the art that the system of controlling the speed and direction of the device 10 can take a number of forms to direct movement of pool skimmer 10 through the water.

As shown particularly in FIG. 2, the pool skimmer 10 has a skimmer net 82 mounted between pontoons 12 and 14. Skimmer net 82 comprises a net 84 consisting of an open fabric of appropriate material with suitable porosity to allow flow of liquid but still retain debris of the desired size. Although primarily intended to collect larger natural debris like leaves, the net 84 can be employed to trap smaller items floating on the surface of the water. The net 84 is configured to cover an elongated area between pontoons 12, 14. It is in the form of upper and lower walls 86 and 88, respectively which are secured to each other around the circumference 90 by appropriate gluing, heat welding and the like. Upper and lower walls 86 and 88 may be a single sheet folded over and secured along two edges where they may be made as separate sheets or as a single unit using appropriate manufacturing technology. The walls 86 and 88, so configured, form an elongated porous pocket extending between pontoons 12 and 14.

Walls 86 and 88 are connected at their forward end to a cross frame 92. Frame 92 may be molded from a single section to embrace and embed in the ends of the net-like walls 86 and 88. However, it may be formed from a wide variety of materials. Frame 92 has an integral T handle 97 extending vertically from the upper leg 94 for convenient manipulation of the skimmer net 82. As shown in FIG. 3, the cross frame 92 is a single piece having an upper leg 94, a lower leg 96 and curved end sections 98 and 100 to form an open, elongated mouth 95. As shown particularly in FIG. 5, the walls 98 and 100 of frame 92 are received within grooves 102 and 104 formed in support webs 106 and 108, extending towards one another from the in-board side of pontoons 12 and 14, respectively.

When the skimmer net 82 is in place, it is held adjacent the front end of the pontoons 12 and 14 with the mouth 95 of frame 92 facing the direction of movement of boat. The water line of the pool skimmer 10 is selected so that it is approximately half way between the upper wall 94 and lower wall 96 of frame 92. This is to ensure that the skimmer can capture both the exposed and submerged sections of leaves. It should be apparent to those skilled in the art that the design waterline can be manipulated up or down to suit particular requirements.

As noted, particularly in FIG. 2 and FIG. 4, the propulsion units 60 and 62, and more particularly the propellers 64 and 66, do not extend beyond the stern 20 and 22 of the pontoons 12 and 14. Furthermore, the propellers do not extend below the lower-most section of pontoons 12 and 14 at the aft end of the pontoons. This is done to protect the propellers 64 and 66 when the unit 10 is placed flat on a surface or placed on end by positioning it on stern 20 and 22. In order to ensure that the propellers 64 and 66 are sufficiently submerged in the water in spite of having their outer diameter at least as high as the bottom of sterns 20 and 22, the weights 56 and 58 are positioned to provide a weight distribution of 60/40 biased toward the aft end (stern) of device 10. Approximately the same non-linear weight distribution is achieved if the weights 56 and 58 are replaced with thicker walls 55 and/or added ribs 57. It is also contemplated that smaller weights could be used in combination with the thicker walls and/or added ribs. This non-linear weight distribution causes a slight positive angle of attack, but more importantly causes the sterns 20 and 22 of pontoons 12 and 14 to be sufficiently immersed in the water to allow optimum propulsion from propellers 64 and 66. It should be apparent that other weight distributions may be used as needed for particular applications.

In operation, the pool skimmer 10 is placed in a pool, pond, or other body of water to be cleaned and is operated by an operator on shore or at the edge of the pool to direct the skimmer 10 towards the debris on the surface. As the skimmer proceeds through the water, it is aimed at, and collects the debris in the skimmer net 82. The above pool skimmer does a very effective job of cleaning debris from the water surface. Since the skimmer 10 has the appearance of a model boat and is radio controlled, it is far more entertaining for a person, and particularly children, to use this device to clear a pool of surface debris.

When the skimmer net 82 is to be emptied, skimmer 10 is brought to the side of the pool or shoreline and the skimmer net 82 is lifted from the grooves 102 and 104 by means of the T handle 97 on the upper wall 94. Since grooves 102 and 104 are curved, it allows the frame 92 to be easily withdrawn from the grooves by pivoting the side nearest to the waters'edge. This facilitates removal of the debris without the need to remove the entire vessel from the water.

The curved frame 32 at the bow of the pontoons 12 and 14 not only provides structural interconnection, but allows easy access to the skimmer net 82. The rollers 46 prevent tearing of vinyl linings in some swimming pools when the pool skimmer is driven into the side. In addition, the rollers 46 allow the pool skimmer to be smoothly guided through a turning maneuver along the side.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claim is:

1. A remote control pool skimmer comprising:

a pair of elongated buoyant hulls spaced from one another, each having a bow and a stern, and at least one cross member interconnecting said hulls;

a remotely controlled drive system connected to said skimmer for moving said hulls through water in a given direction;

a removable net spanning the space between said buoyant hulls and oriented to collect surface debris as the hulls move through water, said hulls being weighted non-linearly from bow-to-stern with greater weighting toward the stern;

wherein said hulls have aligned opposing cradles in which said net is nestled in position on said skimmer;

wherein said net comprises a mouth of frame material and an enclosed net extending therefrom, said mouth extending between said hulls and having ends received in said opposed cradles; and wherein said mouth has curved ends and said cradles have curved configurations for receiving said net, said mouth having a handle extending upward from said frame material.

2. A remote control pool skimmer, as claimed in claim 1, wherein said drive system comprises at least one motor having a propeller engaging the water for propelling said skimmer.

3. A remote control pool skimmer, as claimed in claim 2, having a pair of motors and propellers, said motors being independently operable to steer the skimmer by differential propulsion.

4. A remote control pool skimmer, as claimed in claim 3, wherein said motors are on said cross member.

5. A remote control pool skimmer, as claimed in claim 4, wherein said cross member is adjacent the stem of said hulls, the net being adjacent the bow of said hulls.

6. A remote control pool skimmer, as claimed in claim 4, wherein said motors are electrically powered and radio controlled.

7. A remote control pool skimmer, as claimed in claim 2 wherein said propeller is no lower then the bottom of said hulls.

8. A remote control pool skimmer, as claimed in claim 7, wherein said propeller is no more aft than the sterm of said hulls.

9. A remote control pool skimmer, as claimed in claim 1, wherein said buoyant hulls are substantially parallel to one another.

10. A remote control pool skimmer comprising:

a pair of elongated buoyant hulls spaced from one another, each having a bow and a stern, and at least one cross member interconnecting said hulls;

a remotely controlled drive system connected to said skimmer for moving said hulls through water in a given direction;

a net spanning the space between said buoyant hulls and oriented to collect surface debris as the hulls move through water, said hulls being weighted non-lineary from bow-to-stern with greater weighting toward the stern;

a pair of cross members, one of which is adjacent the stern and the other of which is at the bow; and wherein the cross member at the bow of said hull is curved in a forward direction.

11. A remote control pool skimmer, as claimed in claim 10, wherein said bow cross member has a plurality of rollers each being journaled about a vertical axis for facilitating movement of said pool skimmer around a corner of a pool.

* * * * *